US009047998B2

(12) United States Patent
Jansen et al.

(10) Patent No.: US 9,047,998 B2
(45) Date of Patent: Jun. 2, 2015

(54) METHOD OF PRODUCING RADIONUCLIDES

(75) Inventors: David Randall Jansen, Murrayfield (ZA); Geert Cornelis Krijger, Amsterdam (NL); Zvonimir Ivica Kolar, Delft (NL); Jan Rijn Zeevaart, Florauna (ZA)

(73) Assignee: The South African Nuclear Energy Corporation Limited, District Brits (ZA)

( * ) Notice: Subject to any disclaimer, the term of this patent is extended or adjusted under 35 U.S.C. 154(b) by 0 days.

(21) Appl. No.: 13/583,917

(22) PCT Filed: Mar. 10, 2011

(86) PCT No.: PCT/IB2011/050998

§ 371 (c)(1),
(2), (4) Date: Mar. 18, 2013

(87) PCT Pub. No.: WO2011/111010

PCT Pub. Date: Sep. 15, 2011

(65) Prior Publication Data

US 2013/0170593 A1 Jul. 4, 2013

(30) Foreign Application Priority Data

Mar. 10, 2010 (ZA) ..... 2010/01726

(51) Int. Cl.
*G21G 1/06* (2006.01)
*G21G 1/00* (2006.01)

(52) U.S. Cl.
CPC . *G21G 1/06* (2013.01); *G21G 1/001* (2013.01)

(58) Field of Classification Search
CPC ..... G21G 1/00; G21G 1/001; G21G 1/04; G21G 1/06; G21G 2001/001; G21G 2001/0094
USPC ..... 376/156, 158, 161, 162, 187, 189
See application file for complete search history.

(56) References Cited

U.S. PATENT DOCUMENTS

| | | | | |
|---|---|---|---|---|
| 2,161,985 | A | 6/1939 | Szilard | |
| 2,532,490 | A * | 12/1950 | Fries | 423/249 |
| 3,234,099 | A * | 2/1966 | Tonks et al. | 376/189 |
| 3,551,119 | A * | 12/1970 | Werner | 423/12 |
| 5,586,153 | A | 12/1996 | Alvord | |
| 2005/0082469 | A1 * | 4/2005 | Carlo | 250/262 |

OTHER PUBLICATIONS

International Search Report mailed Jun. 6, 2011, issued in corresponding International Application No. PCT/IB2011/050998, filed Mar. 10, 2011, 2 pages.

* cited by examiner

*Primary Examiner* — Jack W Keith
*Assistant Examiner* — Marshall O'Connor
(74) *Attorney, Agent, or Firm* — Christensen O'Connor Johnson Kindness PLLC

(57) ABSTRACT

The invention relates to a method of producing radionuclides. According to the method, a target medium comprising at least a target nuclide material is irradiated in an irradiation zone with neutron irradiation. Radionuclides form in the target nuclide material as a result of the irradiation, and at least some of the formed radionuclides are ejected from the target nuclide material. The ejected radionuclides are then captured and collected in a carbon-based recoil capture material which does not have an empty cage structure at crystallographic level.

14 Claims, No Drawings

METHOD OF PRODUCING RADIONUCLIDES

THIS INVENTION relates to production of radionuclides. More particularly, the invention relates to radionuclides produced according to the Szilard-Chalmers principle and having a high specific activity. The invention accordingly provides for a method of producing such radionuclides, and extends also to radionuclides produced by the method. The invention also provides for a radionuclide production arrangement.

A common cause of complications in the treatment of cancer in patients is metastasis of the cancer, particularly in bone. Metastasis is a condition whereby the cancer spreads from a primary site thereof in the body, such as the breast or prostate, and localizes in another organ, such as bone. Pain and discomfort are common symptoms and side effects of metastatic bone cancer, and usually renders separate therapy or treatment of the cancer at the primary site futile, often resulting in the cancer being fatal to the patient. Palliation of bone pain emanating from metastatic bone disease, is generally effected by radionuclide therapy (RNT), also known as radioisotope therapy (RIT). RNT, or RIT, involves administering a radiation source to a target area, such as bone to which the cancer has spread, thereby to irradiate the target area and to contain cancerous growth in the area. This may serve to reinforce and supplement the separate treatment of the primary cancer. Particularly in the treatment of bone metastasis, radiation sources with short range emission and high specific activity are desired, so as respectively to reduce the exposure of sensitive bone marrow to radiation and to obtain a high anti-tumour effect with limited or minimal radiation dosage, thereby reducing radiation exposure to the rest of the body.

It is well known in the field of the invention that high specific activity radionuclides, including metastable radionuclides, can be produced by irradiating a suitable target medium, comprising a target nuclide material, with neutron irradiation so that incident neutrons react with target nuclei in the target nuclide material to effect a neutron (n) absorption—gamma (γ) emission nuclear reaction, also expressed as (n, γ). Resulting metastable radionuclides in the target medium gain high recoil energy from the γ-emission and are ejected or recoiled from the original target lattice, i.e. the target nuclide material. These ejected radionuclides are then captured and trapped in a recoil capture material or medium (RCM), which is provided in close proximity with the target medium, with the ejected radionuclides thus being separated from inactive or cold target nuclei in the target nuclide material. The ejected metastable radionuclides are thus concentrated or enriched, relative to the cold nuclei, in the recoil capture material. This process is generally referred to as the Szilard-Chalmers principle. The recoil nuclei are then recovered from the recoil capture material.

The present invention seeks to provide a viable method of producing radionuclides with high specific activity and short range radiation emission using the Szilard-Chalmers principle.

Thus, in accordance with the invention, there is provided a method of producing radionuclides, which includes in an irradiation zone, irradiating a target medium, comprising at least a target nuclide material, with neutron irradiation, thereby causing radionuclides to form in the target nuclide material, with at least some of the formed radionuclides being ejected from the target nuclide material; and capturing and collecting the ejected radionuclides in a carbon-based recoil capture material which does not have an empty cage structure at crystallographic level.

The target nuclide material may be selected from the group consisting of a pure metal and a metal compound. Preferably, the target nuclide material may comprise a metal compound, including a metal oxide, a metal salt, or an organometallic compound. The metal of the target nuclide material may, in particular, be selected from the group of metal elements in the Periodic Table of Elements extending from scandium (Sc), of atomic number 21, to bismuth (Bi), of atomic number 83, both elements included, with the non-metal elements arsenic (As), selenium (Se), bromine (Br), krypton (Kr), tellurium (Te), iodine (I) and xenon (Xe) thus being excluded. Preferably, the metal may be tin (Sn). In such case, the target nuclide material may thus typically be selected from elemental tin or tin metal, as well as from oxides of tin, including tin(II) oxide (SnO) and tin(IV) dioxide ($SnO_2$). The target nuclide material may instead be selected from salts of tin, including tin(II) chloride ($SnCl_2$), tin(IV) chloride ($SnCl_4$), tin(II) sulphate ($SnSO_4$), and tin(II) nitrate ($Sn(NO_3)_2$). The target nuclide material may further instead be selected from organometallic compounds of tin, including tetraphenyl tin, tin(IV)-phthalocyanine oxide, tin(II)-phthalocyanine, and tin(II)-2,3-naphthalocyanine.

The carbon-based recoil capture material may be selected from amorphous carbon, carbon allotropes, and mixtures thereof. More particularly, the recoil capture material may be selected from isotropic amorphous carbon; carbon allotropes such as graphite, graphene, carbon nanofoam, carbon black, charcoal, activated carbon and glassy carbon; or mixtures thereof. Isotropic amorphous carbon and carbon allotropes, such as those identified above, are characterized thereby that they do not have, at crystallographic level, so-called empty cage structures which are readily deformed by radiation when exposed to neutron irradiation.

The target nuclide material and the recoil capture material may both be in finely divided particulate form, each typically having a mean particle size of at most about 50 nm. Desirably, the target nuclide material may have a mean particle size as small as can be obtained, generally being in the order of about 50 nm to about 10 μm.

When both the target nuclide material and the recoil capture material are in particulate from as described above, the method may include mixing the target nuclide material and the recoil capture material. It will be appreciated that, in such an embodiment, the recoil capture material will also be present in the irradiation zone while the neutron irradiation occurs, with the target medium thus comprising both target nuclide material and recoil capture material. It is expected that the ratio in which the target nuclide material and recoil capture material will, in such a case, be mixed, may be determined by routine experimentation and optimization. Conveniently, however, the target nuclide material and recoil capture material may be mixed in a 1:1 ratio, by weight.

Irradiating the target medium may include placing the target medium in the path of a neutron flux from a neutron source. In one embodiment of the invention, the neutron source may be nuclear fission products of a nuclear fission reaction taking place inside a nuclear reactor. The method may then include placing the target medium in a position relative to the nuclear reactor where the neutron flux from the nuclear fission products is sufficiently high and has kinetic energy within a range that is compatible with the desired reaction with the target nuclide material. Alternatively, the neutron source may be an accelerator-based neutron source. An example of such a source is the Spallation Neutron Source (SNS) at Oak Ridge National Laboratory, Oak Ridge, Tennessee, USA.

The method may include recovering the captured radionuclides from the recoil capture material.

Preferably, recovering the captured radionuclides from the recoil capture material includes treating the recoil capture material with a dilute and/or a concentrated acidic extraction solvent, thereby to form a recoil capture material suspension, and chemically extracting or leaching captured radionuclides from the recoil capture material, to obtain a radionuclide-enriched extraction solvent. Thus, it is envisaged that the recoil capture material may be treated either with a dilute acid or with a concentrated acid or, alternatively, with both a dilute and a concentrated acid, separately from each other, e.g. in the form of a two-step treatment.

Particularly when the extraction solvent is a dilute acid, recovery of the captured radionuclides from the recoil capture material may include eluting the captured radionuclides from the recoil capture material by dissolution of the captured radionuclides in the dilute acid. The acid may be selected from hydrochloric acid and ascorbic acid. The acid may also be selected from other mineral or organic acids, including nitric acid, sulfuric acid, fluorosulfuric acid, phosphoric acid, citric acid, oxalic acid, acetic acid, and Meldrum's acid. It will be appreciated that the acid may also comprise a combination of any two or more of the abovementioned acids. Preferably, the acid may be diluted to a concentration of the order of 0.01 mol $dm^{-3}$ to 10 mol $dm^{-3}$, typically about 0.5 mol $dm^{-3}$.

The method may include incubating the recoil capture material suspension for a prolonged period, preferably not exceeding the half-life of the product radionuclide. It is expected that such incubation of the recoil capture material would allow for more optimal recovery of the captured radionuclides from the recoil capture material to the elutrate or leachate. By "more optimal recovery" there is meant the procurement of a desired yield of captured radionuclides as measured in terms of its gamma activity and converted into an enrichment factor relative to total tin content in the elutrate. Alternatively, the method may include increasing the rate of elution by selecting appropriate reaction conditions, such as temperature, acidity and acid strength, and/or by using ultrasonic treatment to facilitate dislodgement of the captured radionuclides into the surrounding suspension. It is expected that such reaction conditions would be determinable by routine experimentation.

The method may also include maintaining the pH of the recoil capture material suspension sufficiently low to avoid untimely hydrolysis of the extracted radionuclide atoms. Maintaining the pH may include selectively adding dilute acid solutions to the suspension.

When the extraction solvent comprises a concentrated acid, the acid may typically be a more corrosive acid than those indicated above. The method may then include dissolving or stripping the recoil capture material in such acids.

Such more corrosive acids may include aqua regia, which is a 1:3 volumetric mixture of concentrated nitric acid and hydrochloric acid, chromic acid, hydrofluoric acid, or combinations of these acids.

The method may further include, when recovering radionuclides from the recoil capture material by treating the recoil capture material with an acidic extraction solvent, recovering or separating radionuclide-enriched extraction solvent from the recoil capture material by means of centrifugation, vortex separation and/or filtration.

Alternatively, recovering the captured radionuclides from the recoil capture material may include treating the recoil capture material with an alkaline extraction solvent. Preferably, the alkali may be sodium hydroxide. In such a case, the radionuclides may typically be extracted in the form of radionuclide metal hydroxides. The method may then include recovering or separating recovered radionuclide metal hydroxides from the recoil capture material, typically by means of centrifuge, vortex separation and/or filtration.

Instead, recovering the captured radionuclides from the recoil capture material may include combusting the recoil capture material in oxygen.

It will be appreciated that, when the target medium comprises a mixture of recoil capture material and target nuclide material, as hereinbefore described, at least some target nuclide material may also be present when recovering captured radionuclides from the recoil capture material in the fashion hereinbefore described, e.g. in the recoil capture material suspension. Therefore, the method may include, if desired, separating the recoil capture material from the target nuclide material before recovering radionuclides from the recoil capture material. Such separation may be achieved by means of a liquid-liquid extraction process, typically using an organic liquid and an aqueous liquid as liquid-liquid extraction solvents. Preferably, the organic liquid is selected from tetrabromoethane (TBE) and toluene. The aqueous liquid will, typically, be water. At least some of the target nuclide material contained in the recoil capture material suspension may typically be recovered to the aqueous phase. The method may further include immobilizing the target nuclide material-containing aqueous phase in order to separate it from the RCM-containing organic phase. Typically, immobilization of the aqueous phase may be achieved by addition of any suitable natural clay or synthetic crack filler to the recoil capture material suspension, thereby to absorb the aqueous phase. The clay may be selected from clays having a high water absorbing capacity which swell extensively when exposed to water. It is expected that such clays will fill, i.e. immobilize, the aqueous phase before the target nuclide material can settle out. Preferably, the clay may be selected from montmorillonite clays, such as bentonite clays, Ca-bentonite clays, attapulgite, MD-Bentonite and Eccabond-N/Bentonite.

The invention extends to radionuclides when produced by the method of the invention.

According to another aspect of the invention, there is provided a radionuclide production arrangement, which includes

- an irradiation zone, in which a target medium comprising at least a target nuclide material is provided;
- a neutron irradiation source, which is provided in a neutron irradiation relationship with the target medium in the irradiation zone; and
- a carbon-based recoil capture material, arranged to capture radionuclides which are ejected from the target nuclide material, the carbon-based recoil capture material not having an empty cage structure at crystallographic level.

The target nuclide material and the recoil capture material may be as hereinbefore described. The neutron irradiation source may also be as hereinbefore described.

The invention will now be described in more detail with reference to the following non-limiting examples.

In the examples, tin (Sn) has been selected as the metal for the target nuclide material, particularly because of its preference in the treatment of certain cancers and because activated metastable (m) tin-117 ($^{117m}$Sn) can be easily detected due to its ideal 160 keV gamma emission using conventional gamma detectors. Thus, in the case of tin, high specific activity $^{117m}$Sn is produced by neutron irradiation of a target medium containing tin-116 ($^{116}$5n) according to the following (n, γ) nuclear reaction:

$$^{116}\mathrm{Sn}(n,\gamma)\,^{117m}\mathrm{Sn} \quad (1)$$

whereby the resulting radioactive $^{117m}$Sn nuclei gain high recoil energy from the γ-emission and the $^{117m}$Sn atoms are thus ejected or recoiled from the original lattice of the target nuclide material.

All reagents were of analytical grade and were obtained from Merck KGaA, Darmstadt, Germany and from Sigma-Aldrich Chemie GmbH, Steinheim, Germany.

EXAMPLE 1

The target medium was selected from combinations of >99% pure SnO, in powder form having a mean particle size of 10 micron powder and $SnO_2$ in nano-powder form, as target nuclide material, and >99% pure carbon in nano-powder form or graphite powder, as recoil capture material.

Solutions of ascorbic acid and hydrochloric acid (HCl) were each prepared at a concentration of 0.50 mol dm$^{-3}$ for extracting recoiled $^{117m}$Sn atoms from the carbon or graphite recoil capture material, after irradiation, i.e. after the $^{116}$Sn(n, γ) $^{117}$m Sn reaction (1).

Target media were prepared as indicated in Table 1, comprising combinations of 50 mg (0.37 mmol) SnO, or 50 mg (0.33 mmol) $SnO_2$, admixed with 50 mg of carbon nano-powder or graphite powder as recoil capture material.

The prepared target media were then sealed in polyethylene capsules. Two targets of each combination of target nuclide material and recoil capture material were prepared: one to be extracted using the 0.50 mol dm$^{-3}$HCl solution, and the second to be extracted with the 0.50 mol dm$^{-3}$ ascorbic acid solution.

The target media were prepared for irradiation at the nuclear reactor of the Reactor Institute of the Delft University of Technology, Delft, Netherlands (TU Delft). The target media were then irradiated for a period of 10 hours and left to cool over a five day period in order to allow the samples to cool down or decay to lower radiation levels for safer handling and to reduce false counts from short-lived contaminants.

The recoiled $^{117m}$Sn radionuclides were extracted from the carbon or graphite media with the pre-prepared HCl and ascorbic acid solutions. A volume of 10 ml each of the respective acid solutions was added respectively to the irradiated target media, including the polyethylene capsule, which was opened, thereby to form respective suspensions of the target media, comprising the target nuclide material and the capture media, in the acid solutions. A 2 ml sample of each suspension was immediately taken to assay the total target yield or background of dissolved un-irradiated oxides as reference for the enrichment factor, whereafter the volume was topped up with 2 ml of the corresponding acid solution and left to incubate at room temperature, respectively for periods of 0.25 hour, 0.5 hour, 1 hour, 5 hours, 48 hours, and 7 days.

At the respective time intervals as indicated in Table 1 below, 2 ml samples of the suspensions were extracted by filtering through a 0.22 μm filter. The $^{117m}$Sn ions that had been dissolved or leached from the recoil capture material into the acidic solutions were maintained in solution as described hereinbefore and were collected in the filtrate, with the un-reacted, or non-recoiled, stable tin-oxide target nuclide material and the recoil capture material essentially remaining behind in the filter, to be flushed back into the capsule with the 2 ml top-up solution for further leaching. Thus, the filtrate contains a concentrate of the radioactive $^{117m}$Sn radionuclides enriched relative to any dissolved un-reacted tin oxide. Samples taken after the 7-day incubation period, as identified in Table 1 below, were taken after having placed the recoil capture material suspensions in an ultrasonic bath for 1 hour. Up to the 60 minute sample the suspensions were topped up again to maintain a fixed volume of 10 ml, and were vortex mixed at 15 minute intervals.

In a separate set of tests, target media were prepared in triplicate to reproduce the results obtained by ultrasonic treatment. These were incubated for 48 hours at which time samples were taken before and after ultrasound exposure of 1 hour. A second set of samples were taken on day 7 of the trial. The $^{117m}$Sn activity within the 2 ml samples were then determined by γ-spectroscopy and calculated back to end of bombardment (EOB). These were analyzed at the Instrumental Neutron Activation Analysis (INAA) facility at the Department of Radiation, Radionuclides & Reactors, Faculty of Applied Sciences, Delft University of Technology. For the determination of the specific activity and enrichment factors, the total tin concentration was measured by Inductively Coupled Plasma-Optical Emission Spectroscopy (ICP-OES) at the appropriate tin wavelength of 189.926 nm.

The method of this embodiment of the invention successfully concentrated $^{117m}$Sn radionuclides in both the graphite as well as the amorphous carbon recoil capture media, achieving for $SnO_2$ an enrichment factor of 34 (as indicated in Table 1), with a specific activity and yield of 2.53 MBq mmol$^{-1}$ and 0.07%, respectively, in 0.50 mol dm$^{-3}$HCl solution. On the other hand, SnO yielded lower specific activities, probably due to the relative ease of dissolution of the unirradiated target SnO in the acidic medium used.

Acidic solutions were used to maintain low pH conditions for the extraction of the radionuclides from the recoil capture medium, minimizing the chance of hydrolysis of the recoil tin ions and their eventual precipitation, especially for $SnO_2$ (i.e. $Sn^{4+}$), which would make the recoiled tin and target tin oxide(s) virtually inseparable by filtration. Both the ascorbic acid and HCl are strong reducing agents and minimize the oxidation of the dissolved $^{117m}$Sn, which could similarly lead to hydrolysis. Ascorbic acid, being a weak acid (pH 2), is less reactive than HCl (pH 0.4). This was considered as being beneficial for achieving higher specific activity, since the stronger HCl also readily dissolves the un-irradiated target oxides, an effect which is even more prominent for SnO, which was about 1000 times more soluble than $SnO_2$ in HCl (Table 1 compared to Table 2).

In Table 1, the results of the analysed samples are given for extraction with HCl, while Table 2 below displays the same for extraction with ascorbic acid. For the $SnO_2$ the amount of dissolved tin was generally constant up to about 3 days of incubation. However, SnO was more labile and exhibited a moderate increase in dissolved tin with time. Being an organic acid, the ascorbic acid has an advantage as it allows the carbon or graphite particles to suspend or disperse in solution due to a moderate apolar, hydrophobic effect, thus, allowing for a larger surface area for contact with the acid to effectively extract the recoiled activity. Furthermore, ascorbic acid is reported to act as a complexing agent, which could then bind the extracted $^{117m}$Sn ions and keep them in solution, in so doing minimizing the hydrolysis of tin and allowing for separation by filtration.

Additional control experiments were carried out (Table 3) in which the extraction procedure was repeated using un-irradiated (cold) $SnO_2$ and SnO, for HCl and ascorbic acid, to determine the extent to which the acids dissolve the oxides—the dissolved tin content was measured by ICP-OES. These tests served to verify the reactivity of the tin oxides with the respective acids.

The effectiveness and success of the extractions was monitored by the enrichment factors achieved at each step in the process. This was calculated as the ratio of the $^{117m}$Sn specific activity of the samples (at each time point) and the initial total target yield. The initial total target yields were 0.11±0.02 MBq mmol$^{-1}$ and 0.10±0.02 MBq mmol$^{-1}$ for $SnO_2$ and SnO, respectively. Tables 1 and 2 show the trend in the specific activity (MBq mmol$^{-1}$) achieved at the selected intervals (15, 30 and 60 minutes, 5 and 48 hours), as calculated as the ratio of the measured $^{117m}$Sn activity (MBq ml$^{-1}$)—as determined by γ-spectroscopy—and the tin concentration (mmol dm$^{-3}$)—as measured by ICP-OES. Following the irradiation the $^{117m}$Sn was dissolved to yield enrichment factors between 2 and 34.

Generally speaking, both solutions, HCl and ascorbic acid, were effective in extracting the $^{117m}$Sn. However, the more reactive tin oxide, SnO, and the stronger acid solution, HCl, respectively, seem to produce higher yields, albeit their specific activities and enrichment factors are lower. As a result $SnO_2$ performed better, while extraction with ascorbic acid proved futile, as observed by the undetectable $^{117m}$Sn activity in Table 2. An enrichment factor of 34 and 0.07% yield was achieved in the presence of carbon—after treatment with 0.50 mol dm$^{-3}$ HCl (Table 1).

Ultrasonic treatment for 1 hour, after 48 hours and 7 days incubation respectively, had no significant effect on the specific activity, and hence the enrichment factor remained substantially unchanged. As a control, other isotopes were also monitored during this study, namely $^{113}$Sn, $^{113m}$Sn, $^{125}$Sn and $^{125m}$Sn, and their enrichment factors were similar to that of $^{117m}$Sn. This was to be expected, as they are produced by the same (n, γ) reaction, and especially since the energies of their prompt γ-rays are similar.

It is foreseen that the best extraction medium could possibly be a combination of ascorbic acid and HCl, since HCl is better at dissolving the recoil activity, whilst ascorbic acid allows for greater surface area with the recoil capture material whilst simultaneously complexing the $^{117m}$Sn, keeping it in solution and preventing unwanted hydrolysis and precipitation. Further optimization will be required of the combination and the ideal concentration of each, e.g. by a speciation study using glass electrode potentiometry. Obviously, longer irradiation times will also increase the yields and/or enrichment factors.

EXAMPLE 2

In another example of the invention, the option to separate and isolate the recoil capture material from the oxides prior to extraction with acid is investigated. The purpose of this is to minimize the presence of "cold" (un-irradiated) tin, which could lower the specific activity and also avoid any irradiated but un-recoiled [$^{117m}$Sn]SnO or [$^{117m}$Sn]$SnO_2$ from being taken up into the acid extract/filtrate, which could produce false positives. One such method involves an initial organic/aqueous liquid-liquid extraction in which the post-irradiated material is added to water and tetrabromoethane (TBE) or toluene, respectively. The choice of the organic solvent depends on the preferred orientation of the organic and aqueous phases.

In the separation using TBE and water (first column under each oxide, Table 4), the tin-oxides remain suspended in the top aqueous layer whilst the carbon or graphite is distributed in the organic layer below. The carbon and graphite does not dissolve in the solvents per se, but separation is achieved due to differences in polarity of the recoil capture media and the tin oxides. The $^{117m}$Sn activity distribution of the organic and aqueous phases, as well the utensils (i.e. glassware and syringes), were measured in a Capintec ionization chamber and yield the results as seen in Table 4. Although meticulous handling was required, fairly good separation was achieved. However, the oxides eventually settled at the aqueous-organic interface, i.e. at the bottom of the aqueous layer on top, which in the event of overshooting during the separation of the phases, became extracted with the TBE phase instead, as seen in the TBE columns of Table 4.

When toluene is used instead of TBE, the organic and aqueous phases are inverted, i.e. the toluene layer is on top. In so doing the settling of the tin-oxide at the bottom of the (bottom) aqueous layer, away from the organic phase, makes the extraction more efficient (Toluene column under each oxide, Table 4), effectively minimizing the chance of collecting the oxide with the graphite or carbon. The separation was good and required less handling. Furthermore, there was a lower risk of having the tin oxide present in the organic phase. However, a thin film of toluene had developed around the surface of the water component, which contained some graphite, and was not easily separated.

In the tests under this example the recoil activity was not extracted from the recoil capture media, while it merely served as a demonstration of the feasibility of these steps. Water was used in the extractions and not acid or buffer solution so as to avoid premature extraction of the recoil $^{117m}$Sn ions from the recoil capture media, which then could end up in the aqueous phase. Although the inventors have found the liquid-liquid extraction method to be cumbersome and sensitive to overshooting, refinement of the steps may prove it to be a valid process step.

Furthermore, although yields are not significant (2.2% and 2.6% respectively), the objective would be purely to achieve a higher ratio of radioactivity (Bq or Ci) per mass or volume of the product nuclide. The yields can eventually be improved by further experimentation and optimization.

EXAMPLE 3

In a further example, the phase separation option outlined in Example 2 is extended to include the immobilization with clay of the aqueous phase containing the oxide to allow for the organic layer to be decanted or washed away for further processing and extraction of the recoil $^{117m}$Sn.

In these experiments 5 clays and a conventional household crack filler was considered as solidifying/immobilizing agent, namely: (1) Bentonite-MD/0104/Environment; (2) Ca-Bentonite/Calcium 100#/0106/1-06-10-12-03; (3) Attapulgite; (4) MD-Bentonite/0101; (5) Eccabond-N/Bentonite; and (6) Alcolin interior crack filler (Polyfilla), all obtained from Koppies in the Orange Free State, South Africa (G & W Base & Industrial Minerals, Germiston, 1428, Gauteng, South Africa), and the household crack filler (Polyfilla) obtainable from any local hardware store. These were in turn carefully added to the two extraction mixtures of Example 2 until the aqueous phase was saturated with the respective clay. Approximately 1 g of clay was needed per ml of water. All the clays including the crack filler did not disperse in the organic layers; in the case of toluene they descended straight through unimpeded to eventually react with the water below it. As for TBE, the clays remained dispersed in the upper aqueous layer, with no intrusion into the organic phase. Clays 1, 4 and 5 performed similar throughout, reacting slowly with the water and without settling out in the aqueous layer. Instead, these clays reacted close to the water surface or meniscus. This resulted in some of the unreacted water being trapped below the clay—out of reach of the fresh clay being added. Clays 2 and 3 reacted slower, however they did eventually settle out in the water layer and allowed for good contact and reaction with all the water. The same was observed for the crack filler. Agitating the mixture slightly promoted the settling of the crack filler. Eventually, all the clays swelled up, but not the crack filler. Clays 2 and 3 exhibited the most favourable behaviour and were also the best for use with toluene. The crack filler too behaved well, especially with TBE. However, in the case of the clays, the toluene should be decanted within 15 minutes after introducing the clay, whereas with the crack filler—with either the toluene or TBE—should be allowed to set overnight prior to separation, and even then its hardening is only moderate. In all cases with toluene the clays and crack filler trapped some carbon as it descended through the toluene. To promote sufficient hardening of the crack filler, $Na_2SO_4$ was added to it in a 1:1 mass ratio and in so doing the $Na_2SO_4$ absorbs any excess water so as to facilitate drying and hardening of the crack filler. However, only a slight improvement was achieved.

The inverse approach is also possible, that is, the immobilization or solidification/encapsulation of the recoil capture media using molten paraffin wax, which would replace the organic solvent. However, this would require operating at elevated temperatures so as to avoid inappropriate hardening of the wax.

An alternative means of separation could be by dry density separation of the powders in a shaking device.

It is envisaged that once the recoil capture material can be successfully separated from the oxides the recoil activity can be isolated or extracted by means of acid leaching, as above, or by combustion of the carbon-based material in oxygen to yield [$^{117m}$Sn]$SnO_2$ or [$^{117m}$Sn]SnO and carbon-dioxide gas.

It is believed that the specific methods employed in Examples 1-3 provide a preferred route from a production perspective, as the forms of the target nuclide materials used were resilient and favourable for both harsh radiation conditions and simplicity of post irradiation work-up and isolation.

Radiolabelled tin II and IV, i.e. [$^{117m}$Sn]—Sn(II) and [$^{117m}$Sn]—Sn(IV), have been proposed as constituents of prospective radiopharmaceuticals for the palliation of bone pain by RNT. The radionuclide $^{117m}$Sn emits conversion electrons upon decay and has been reported to have a short range of about 0.2 mm to 0.3 mm in tissue, which renders $^{117m}$Sn ideal for treatment of bone cancer, as the exposure of sensitive bone marrow to radiation, and hence the radiotoxicity of $^{117m}$Sn, is limited. Its attractiveness as a radiopharmaceutical is further enhanced by the 159 keV gamma that is emitted in about 86% of decay events, which makes it also an excellent diagnostic imaging radionuclide, e.g. in applications of tumour location.

As illustrated by the examples above, when tin is selected as the preferred target nuclide, the oxides SnO and $SnO_2$ are preferred molecular forms of the target nuclide material. The Applicant has found that the oxides of tin are more resistant to radiation damage during extended irradiation times than other compounds of tin. The Applicant has further found that these oxides of tin are generally chemically inert to extraction solvents used in recovering the captured radionuclides post-irradiation. These oxides of tin are also thermally stable with melting points of 1080° C. and 1127° C. respectively, which is particularly advantageous in the reaction conditions to which the oxides are exposed.

Similarly to SnO and $SnO_2$, as target nuclide materials, the Applicant has also found that carbon and graphite, as recoil capture materials, are able to endure harsh chemical treatment and are inert in dilute acid. The Applicant has found that recoiled $^{117m}$Sn atoms/ions are bound loosely to moderately stably to the recoil capture material. This feature, combined with the robustness of carbon and graphite to harsh chemical treatment and inertness in dilute acid, allows for the atoms/ions to be eluted or leached from the recoil capture material by dissolution of the RCM in a dilute acid. Carbon and graphite, as recoil capture materials, are also robust to exposure to larger neutron fluxes and exposure periods, as opposed to $C_{60}$ fullerenes which can be damaged by epithermal neutrons within 2 hours of irradiation in an unfiltered neutron flux of $10^{14}$ $cm^{-2}s^{-1}$. Graphite is an allotrope of carbon, in which the carbon atoms are covalently bound in flat sheets of fused hexagonal rings. The sheets are loosely stacked and held together by weak Van der Waals forces. Conversely, carbon is amorphous and, unlike graphite, is devoid of a crystalline arrangement of atoms. The inventors do not wish to be bound by theory, but it is expected that the recoiled $^{117m}$Sn atoms/ions become intercalated within the carbon or graphite lattice, from which they can later be extracted by chemical and/or physical means, for example, by burning of the carbon RCM in oxygen to liberate the enriched [$^{117m}$Sn]tin-oxide with the release of $CO_2$ gas.

The Applicant is aware that commercially employed techniques for producing radionuclides known at the time of filing of this application yield $^{117m}$Sn radionuclides with reported specific activities as high as 25 Ci $g^{-1}$ (~88 MBq $mmol^{-1}$) at end of bombardment (EOB) and are obtainable from suppliers such as Curative Technologies Corporation (CTC). Specific activity of this magnitude can be achieved for example by inelastic neutron scattering irradiation of tin metal enriched to 92% in $^{117}$Sn for about 35 days in the high flux SM-3 reactor at the Reactor Institute of Atomic Reactors (RIAR), in Dimitrovgrad, Russia, i.e. by the $^{117}$Sn (n, n") $^{117m}$Sn reaction. Alternatively, $^{117m}$Sn can be produced by epithermal neutron irradiation by the hereinbefore described (n, γ) neutron capture reaction, $^{116}$Sn (n, γ) $^{117m}$Sn, but the reaction rate in terms of neutron capture cross section for this reaction (0.14 barns) is generally considered to be too low to produce $^{117m}$Sn with high specific activity cost effectively by conventional methods.

In the abovementioned (n, γ) reactions, however, the resulting nucleus acquires a recoil kinetic energy, as a result of the prompt γ-ray emission upon neutron capture, which is significantly greater than the activation energy achieved by normal thermal reactions (chemical bond energies are typically in the range of 1-5 eV, and the recoil energies acquired by the nucleus due to the recoil is generally well in excess of 10 MeV), while at the same time the atom is chemically transformed, such that the chemical bonding or valence of the recoiled atom is reduced to a lower state, as also described hereinbefore. This allows for chemical extraction based on bonding differentiation. Further, by applying the phenomenon of "recoil implosion", whereby the recoil radioactive atom is implanted or captured inside an empty fullerene ($C_{60}$ or $C_{80}$) cage, carrier-free radio-chemicals can be prepared, for example metallofullerenes such as $^{177}$Lu@$C_{60}$ and $^{153}$Sm@$C_{80}$, where the lutetium-177 ($^{177}$Lu) and samarium-153 ($^{153}$Sm) become entrapped within $C_{60}$- and $C_{80}$-fullerene cages, respectively. The foregoing is a typical example of a process based on the Szilard-Chalmers principle.

Although fullerenes, and for the same reason buckyballs, as empty cage structures are ideal as RCM in the art of the invention, the shortcoming of this route is that such carbon structures are only capable of withstanding the irradiation in a reactor flux of pure thermal neutrons, but are deformed by radiation damage within 2 hours of exposure to epithermal neutrons.

In the present invention the use of carbon-based materials such as amorphous carbon and graphite, with no "empty cage" structure, are proposed as recoil capture media to capture the $^{117m}$Sn recoil atoms from the (n, γ)-reaction with $^{116}$Sn, as these carbon-based matrixes are less prone to radiation damage. Thus, the problem of achieving high specific activity recoil $^{117m}$Sn at relatively low cost and with minimal waste material is specifically addressed.

TABLE 1

Total tin concentration per extraction sample as measured by ICP OES, the specific activity of $^{117m}$Sn for each and the extraction yield, at various incubation times in 0.50 mol $dm^{-3}$ HCl, for targets containing natural $SnO_2$ and SnO

| Target medium | Time (hours) | $^{117m}$Sn Activity (Bq $ml^{-1}$) | Dissolved Sn (μmol $dm^{-3}$) | Spec. Activity (MBq $mmol^{-1}$) | Enrichment Factor | Yield (%) |
|---|---|---|---|---|---|---|
| $SnO_2$/ | 0.25 | 6.73 | 5.11 | 1.32 | 18 | 0.05 |
| Carbon | 0.5 | 6.49 | 4.26 | 1.53 | 21 | 0.05 |
| | 1 | 8.6 | 3.40 | 2.53 | 34 | 0.07 |
| | 5 | 11.7 | 5.11 | 2.29 | 31 | 0.09 |
| | 48 | 11.8 ± 0.9 | 6.2 ± 1.3 | 1.9 ± 0.4 | 17.5 ± 3.9 | 0.061_ ± 0.002 |
| | 7 days | 7.4 ± 0.7 | 4.5 ± 1.3 | 1.7 ± 0.3 | 15.6 ± 4.5 | 0.038_ ± 0.004 |
| $SnO_2$/ | 0.25 | 10.9 | 5.96 | 1.83 | 22 | 0.08 |
| Graphite | 0.5 | 13.5 | 6.81 | 1.98 | 23 | 0.09 |
| | 1 | 14.7 | 7.66 | 1.92 | 23 | 0.1 |
| | 5 | 17.4 | 7.66 | 2.27 | 27 | 0.12 |
| | 48 | 16.0 ± 2.8 | 9.1 ± 1.0 | 1.8 ± 0.3 | 16.5 ± 1.7 | 0.09 ± 0.01 |
| | 7 days | 9.1 ± 2.3 | 4.5 ± 1.0 | 2.1 ± 0.8 | 20 ± 7 | 0.05 ± 0.01 |
| SnO/ | 0.25 | 3410 | 20800 | 0.16 | 2 | 19.55 |
| Carbon | 0.5 | 2500 | 17400 | 0.14 | 2 | 14.41 |
| | 1 | 2070 | 14500 | 0.14 | 2 | 11.93 |
| | 5 | 1650 | 11350 | 0.15 | 2 | 9.51 |
| | 48 | 3280 ± 250 | 10100 ± 900 | 0.33 ± 0.05 | 3.1 ± 0.4 | 15.6 ± 0.3 |
| | 7 days | 380 ± 150 | 3300 ± 1400 | 0.12 ± 0.02 | 1.11 ± 0.19 | 1.9 ± 0.9 |
| SnO/ | 0.25 | 3260 | 19400 | 0.17 | 2 | 21.95 |
| Graphite | 0.5 | 3010 | 17800 | 0.17 | 2 | 20.27 |
| | 1 | 2510 | 15300 | 0.16 | 2 | 16.9 |
| | 5 | 2140 | 13000 | 0.17 | 2 | 14.41 |
| | 48 | 3870 ± 470 | 8400 ± 2800 | 0.50 ± 0.16 | 4.5 ± 1.8 | 16.5 ± 0.3 |
| | 7 days | 2900 ± 350 | 20500 ± 1300 | 0.14 ± 0.02 | 1.24 ± 0.09 | 12.4 ± 0.3 |

TABLE 2

Total tin concentration per extraction sample as measured by ICP OES, the specific activity of $^{117m}$Sn for each, and the extraction yield, at various incubation times in 0.50 mol $dm^{-3}$ ascorbic acid solution, for targets containing natural $SnO_2$ and SnO. (Where the γ-spectroscopy results were below the detection limit (1.8 Bq per gram of sample), the specific activities and enrichment factors could not be calculated, as represented by the dash (—) in the table.)

| | Time (hours) | $^{117m}$Sn Activity (Bq $ml^{-1}$) | Dissolved Sn (μmol $dm^{-3}$) | Spec. Activity (MBq $mmol^{-1}$) | Enrichment Factor | Yield (%) |
|---|---|---|---|---|---|---|
| $SnO_2$/ | 0.25 | <1.8 | 1.85 | — | — | — |
| Carbon | 0.5 | <1.8 | 1.58 | — | — | — |
| | 1 | <1.8 | 1.48 | — | — | — |
| | 5 | <1.8 | 1.21 | — | — | — |
| | 48 | 3.7 ± 1.3 | 3.1 ± 0.3 | 1.2 ± 0.6 | 11 ± 7 | 0.019 ± 0.010 |
| | 7 days | 3.0 ± 0.7 | 2.4 ± 0.4 | 1.14 ± 0.10 | 10 ± 4 | 0.015 ± 0.008 |
| $SnO_2$/ | 0.25 | <1.8 | 1.58 | — | — | — |
| Graphite | 0.5 | <1.8 | 1.67 | — | — | — |
| | 1 | <1.8 | 1.67 | — | — | — |
| | 5 | <1.8 | 1.39 | — | — | — |
| | 48 | 3.9 ± 0.7 | 3.1 ± 0.5 | 1.27 ± 0.14 | 14 ± 4 | 0.03 ± 0.01 |
| | 7 days | 4.1 ± 1.9 | 2.72 ± 0.14 | 1.54 ± 0.20 | 22.2 ± 0.8 | 0.035 ± 0.030 |
| SnO/ | 0.25 | <1.8 | 5.38 | — | — | — |
| Carbon | 0.5 | <1.8 | 6.30 | — | — | — |
| | 1 | <1.8 | 7.88 | — | — | — |
| | 5 | 4.82 | 32.4 | 0.15 | 5 | 0.09 |
| | 48 | 580 ± 80 | 5400 ± 900 | 0.108 ± 0.008 | 0.99 ± 0.21 | 2.6 ± 0.3 |
| | 7 days | 2170 ± 190 | 20000 ± 900 | 0.108 ± 0.005 | 1.00 ± 0.21 | 9.7 ± 2.5 |
| SnO/ | 0.25 | 1.82 | 27.6 | 0.066 | 1 | 0.02 |
| Graphite | 0.5 | 2.19 | 21.0 | 0.11 | 2 | 0.02 |
| | 1 | 2.83 | 21.7 | 0.13 | 3 | 0.03 |
| | 5 | 3.08 | 23.6 | 0.13 | 3 | 0.03 |
| | 48 | 530 ± 400 | 2900 ± 500 | 0.17 ± 0.11 | 1.9 ± 1.2 | 2.3 ± 1.2 |
| | 7 days | 1770 ± 90 | 17400 ± 700 | 0.102 ± 0.003 | 1.19 ± 0.28 | 9 ± 3 |

TABLE 3

Dissolution of $SnO_2$ and SnO in 0.50 mol $dm^{-3}$ HCl or 0.50 mol $dm^{-3}$ ascorbic acid solutions up to 3 days at ambient temperature

| Tin Oxide | Solution (0.50 mol $dm^{-3}$) | Time (hours) | Dissolved Sn (μmol $dm^{-3}$) |
|---|---|---|---|
| $SnO_2$ | HCl | 0.25 | 3.40 |
| | | 0.5 | 2.55 |
| | | 1 | 4.25 |
| | | 5 | 6.81 |
| | | 48 | 7.66 |
| | | 3 days | 16.2 |
| $SnO_2$ | Ascorbic Acid | 0.25 | 2.69 |
| | | 0.5 | 2.50 |
| | | 1 | 2.32 |
| | | 5 | 2.32 |
| | | 48 | 2.13 |
| | | 3 days | 2.32 |
| SnO | HCl | 0.25 | 8380 |
| | | 0.5 | 21010 |
| | | 1 | 20700 |
| | | 5 | 18780 |
| | | 48 | 17230 |
| | | 3 days | 11060 |
| SnO | Ascorbic Acid | 0.25 | 6.02 |
| | | 0.5 | 9.45 |
| | | 1 | 13.2 |
| | | 5 | 17.5 |
| | | 48 | 19.3 |
| | | 3 days | 21.3 |

TABLE 4

Percentages (%) of $^{117m}$Sn activity present in organic and aqueous phases, following liquid-liquid extraction technique for separation of tin oxides from the carbon-based recoil capture media, carbon or graphite

| Liquid | SnO | | $SnO_2$ | |
|---|---|---|---|---|
| Phase | TBE | Toluene | TBE | Toluene |
| Aqueous | 34.1 | 97.8 | 22.9 | 93.9 |
| Solvent | 57.6 | 2.2 | 50.6 | 2.6 |
| Glassware | 8.2 | | 26.5 | 3.5 |

The invention claimed is:

1. A method of producing radionuclides, which includes in an irradiation zone, irradiating a target medium comprising at least a target nuclide material, with neutron irradiation, thereby causing radionuclides to form in the target nuclide material, with at least some of the formed radionuclides being ejected from the target nuclide material;

capturing and collecting the ejected radionuclides in a recoil capture material which is selected from amorphous carbon, carbon allotropes and mixtures thereof, the amorphous carbon and/or carbon allotropes not having an empty cage structure at crystallographic level, with the ejected radionuclides thereby being concentrated or enriched in the recoil capture material relative to cold nuclei; and recovering the captured radionuclides from the recoil capture material.

2. The method according to claim 1, wherein the target nuclide material is selected from the group consisting of a pure metal and a metal compound.

3. The method according to claim 2, wherein the metal of the target nuclide material is selected from the group of metal elements in the Periodic Table of Elements extending from scandium, of atomic number 21, to bismuth, of atomic number 83, both elements included, with the non-metal elements arsenic, selenium, bromine, krypton, tellurium, iodine and xenon thus being excluded,

4. The method according to claim 3, wherein the metal of the target nuclide material is tin.

5. The method according to claim 1, wherein the target nuclide material and the recoil capture material are both in finely divided particulate form, each having a mean particle size of at most about 50 nm.

6. The method according to claim 5, which includes mixing the target nuclide material and the recoil capture material, with the target medium thus comprising both target nuclide material and recoil capture material.

7. The method according to claim 1, wherein irradiating the target medium includes placing the target medium in the path of a neutron flux from a neutron source.

8. The method according to claim 1, in which recovering the captured radionuclides from the recoil capture material includes treating the recoil capture material with a dilute and/or a concentrated acidic extraction solvent, thereby to form a recoil capture material suspension, and chemically extracting or leaching captured radionuclides from the recoil capture material, to obtain a radionuclide-enriched extraction solvent.

9. The method according to claim 8, which includes incubating the recoil capture material suspension for a period which does not exceed the half-life of the captured radionuclides.

10. The method according to claim 8, which includes recovering or separating radionuclide-enriched extraction solvent from the recoil capture material by means of centrifugation, vortex separation and/or filtration.

11. The method according to claim 1, which includes recovering the captured radionuclides from the recoil capture material by treating the recoil capture material with an alkaline extraction solvent.

12. The method according to claim 1, which includes recovering the captured radionuclides from the recoil capture material by combusting the recoil capture material in oxygen.

13. The method according to claim 8, in which the target medium comprises a mixture of the recoil capture material and the target nuclide material and the method includes separating the recoil capture material from the target nuclide material before recovering radionuclides from the recoil capture material.

14. The method according to claim 13, wherein separating the recoil capture material from the target nuclide material is achieved by means of liquid-liquid extraction, using an aqueous liquid and an organic liquid as liquid-liquid extraction solvents.

* * * * *